US005429572A

United States Patent [19]

Brown et al.

[11] Patent Number: 5,429,572

[45] Date of Patent: Jul. 4, 1995

[54] FRICTION EXERCISE DEVICE HAVING A SINGLE SUPPLY AND TAKE UP REEL

[75] Inventors: Thomas D. Brown, 303 De La Cruz, Weatherford, Tex. 76086; Hulbert R. Helm, Rte. 2, Box 35, Comanche, Tex. 76442

[21] Appl. No.: 262,786

[22] Filed: Jun. 20, 1994

[51] Int. Cl.[6] ..... A63B 21/018

[52] U.S. Cl. ..... 482/116; 482/120

[58] Field of Search ..... 482/114, 115, 116, 120, 482/91, 142, 110

[56] References Cited

U.S. PATENT DOCUMENTS

| | | | |
|---|---|---|---|
| 4,138,106 | 2/1979 | Bradley | 482/116 |
| 4,235,439 | 11/1980 | De Donno | 482/116 |
| 4,479,647 | 10/1984 | Smith | 482/91 |
| 4,557,480 | 12/1985 | Dudley . | |
| 4,779,866 | 10/1988 | Marshall et al. . | |
| 4,871,165 | 10/1989 | Marshall et al. . | |

*Primary Examiner*—Richard J. Apley
*Assistant Examiner*—Lynne A. Reichard
*Attorney, Agent, or Firm*—William E. Hein

[57] ABSTRACT

A portable exercise device includes a base having a flat central section on which the user may either stand, sit or lie and a strap housing on each side of the central section. The base comprises two sections joined by mating extrusions such that the base may be disassembled to provide greater portability of the exercise device. One of the strap housings contains a supply/-takeup reel onto which left and right straps are wound and from which they are unwound during a workout by the user. The right strap is routed underneath the base and around an idler pulley contained within the other housing. Each of the straps exits its respective housing and is connected to one end of an exercise bar. A rewind spring, a one-way clutch, and a band brake are coupled to the supply/takeup reel to adjust the force required of the user to pull the straps during a workout and to rewind the straps when the user releases the bar.

5 Claims, 3 Drawing Sheets

FRICTION EXERCISE DEVICE HAVING A SINGLE SUPPLY AND TAKE UP REEL

BACKGROUND AND SUMMARY OF THE INVENTION

This invention relates generally to exercise devices and, more particularly to a portable exercise device that allows those who travel, for example, to perform the same types of exercises that are usually accomplished at home or at a gym through the use of heavy weight sets or weight lifting machines.

A number of exercise devices are known in the prior art. U.S. Pat. No. 4,557,480 is directed to a portable exercise device that employs a single spring-loaded rope that requires significant rewind space and is subject to stretching. No provision is made for gauging the resistance against which the rope is pulled, and no one-way clutch is provided to release the rope for rewind. Moreover, dual side exercises such as bench presses are not possible with this device.

U.S. Pat. Nos. 4,779,866 and 4,871,165 are directed to portable exercise devices that employ a brake to impart resistance. However, no dual side exercises such as bench presses are possible with these devices.

It is therefore the principal object of the present invention to provide a portable exercise device that enables the user to perform bench presses, dead lifts, military presses, biceps curls, squat thrusts, shoulder shrugs, and calf raises, for example, the same as if the user had access to a basic set of free weights or a weight machine.

It is a further object of the present invention to provide a portable exercise device in which the resistance is indicated to the user and may be easily adjusted to an effective weight sufficient for most experienced users.

It is a further object of the present invention to provide a portable exercise device that is safe, as opposed to weight sets, which may trap the user under a heavy barbell.

These and other objects are accomplished in accordance with the illustrated preferred embodiment of the present invention by providing a base having a flat central section on which the user may either stand, sit or lie and a strap housing on each side of the central section. The base comprises two sections joined by mating extrusions such that the base may be disassembled to provide greater portability. One of the strap housings contains a supply/takeup reel onto which left and right straps are wound and from which they are unwound during a workout by the user. The right strap is routed underneath the base and around an idler pulley contained within the other housing. Each of the straps exits its respective housing and is connected to one end of an exercise bar. A rewind spring, a one-way clutch, and a band brake are coupled to the supply/takeup reel to adjust the force required of the user to pull the straps therefrom when pulling the exercise bar and to rewind the straps when the user releases the bar.

DESCRIPTION OF THE PREFERRED EMBODIMENTS

Figure 1:
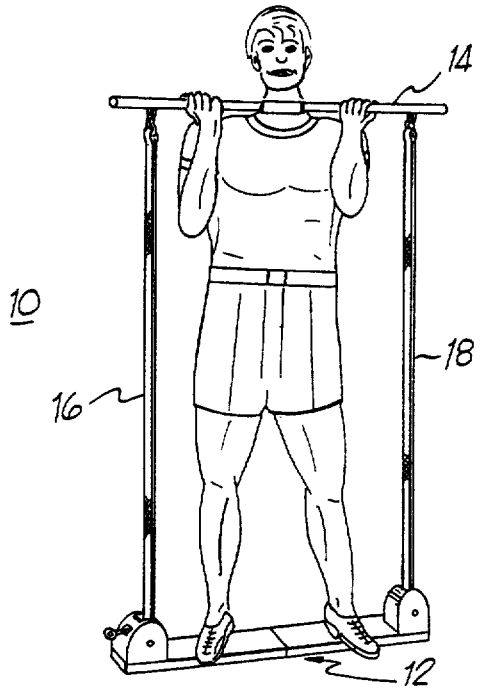
FIG. 1 is an overall pictorial diagram of the portable exercise device of the present invention illustrating the way in which a user may perform exercise from a standing position.
Figure 2:
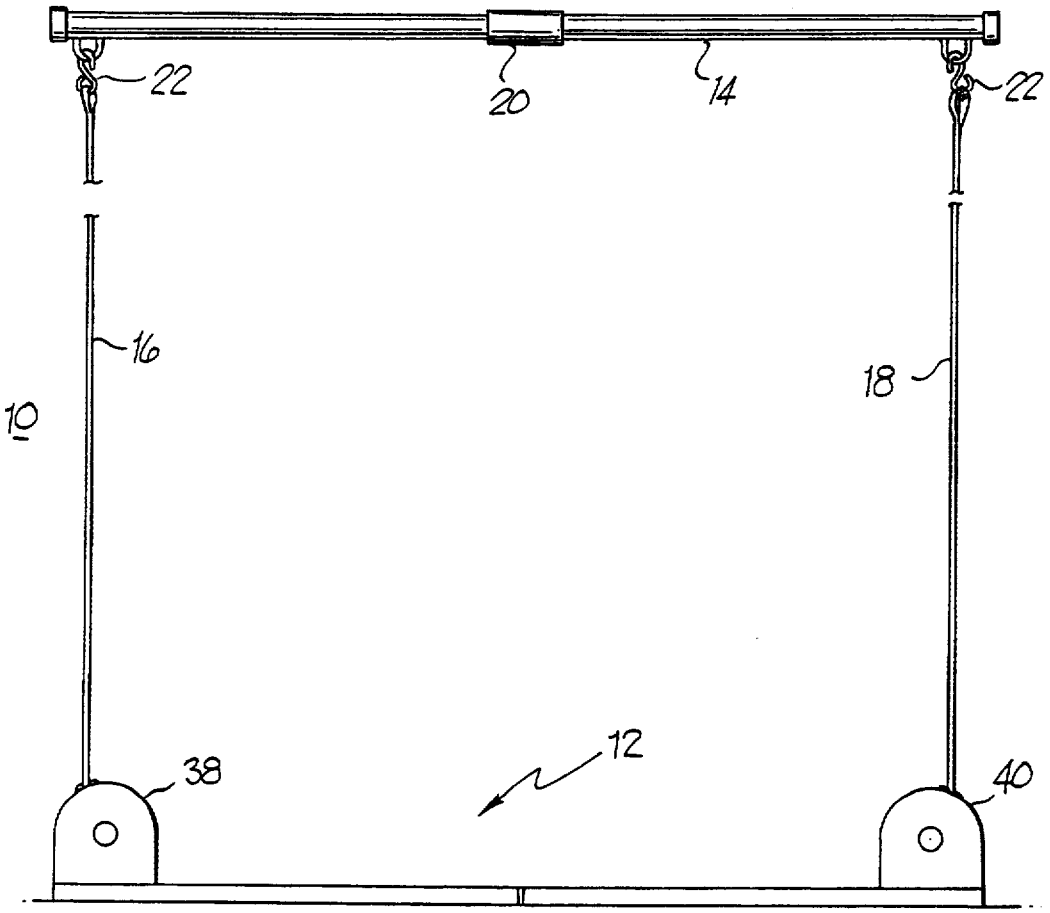
FIG. 2 is a front elevation view of the portable exercise device of FIG. 1 illustrating an exercise bar in its extended position.

Referring now to FIGS. 1 and 2, there is shown a portable exercise device 10 in which a user may either stand, sit or lie on a base 12 having a flat central portion to perform a number of exercises such a bench presses, dead lifts, military presses, biceps curls, squat thrusts, shoulder shrugs, and calf raises, for example. These exercises are performed by raising a bar 14 that is connected to base member 12 via left and right straps 16, 18. Straps 16, 18 may be fabricated of a commercially available woven fabric. Bar 14 may be formed of two telescoping members, for example, to facilitate disassembly and adjustment of the overall length thereof by means of a clamping member 20. Any of a number of different types of hooks 22 may be provided on bar 14 for attachment of straps 16, 18 thereto.

Figure 3:
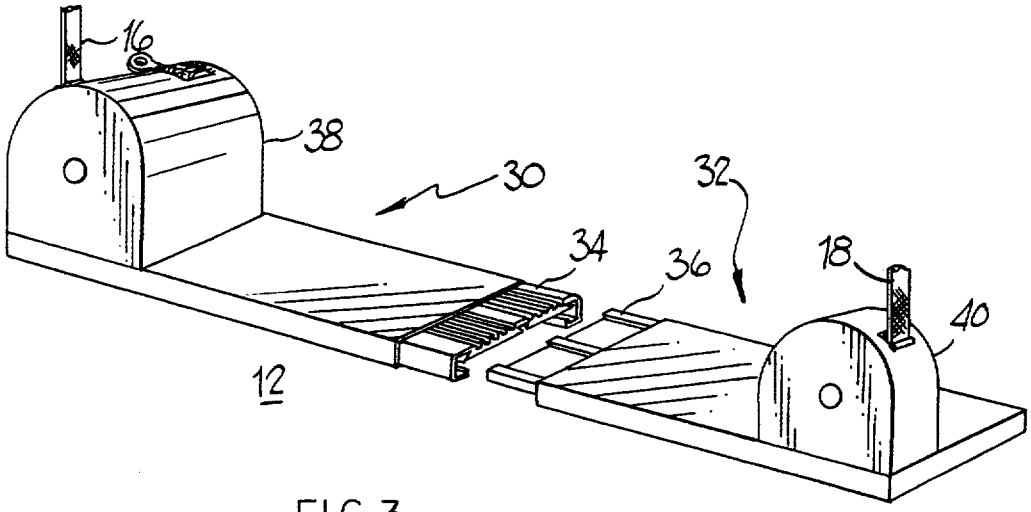
FIG. 3 is a detailed pictorial diagram of a base of the portable exercise device of FIGS. 1 and 2.
Figure 4:
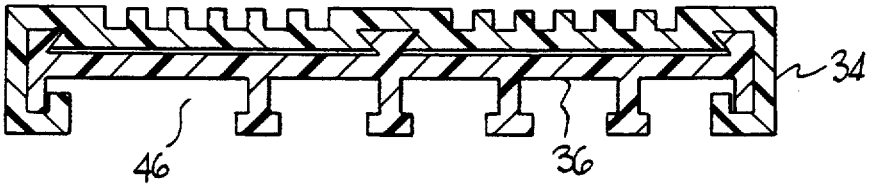
FIG. 4 is a cross-sectional view of a pair of mating extrusions that form a portion of the base of FIG. 3.
Figure 5:
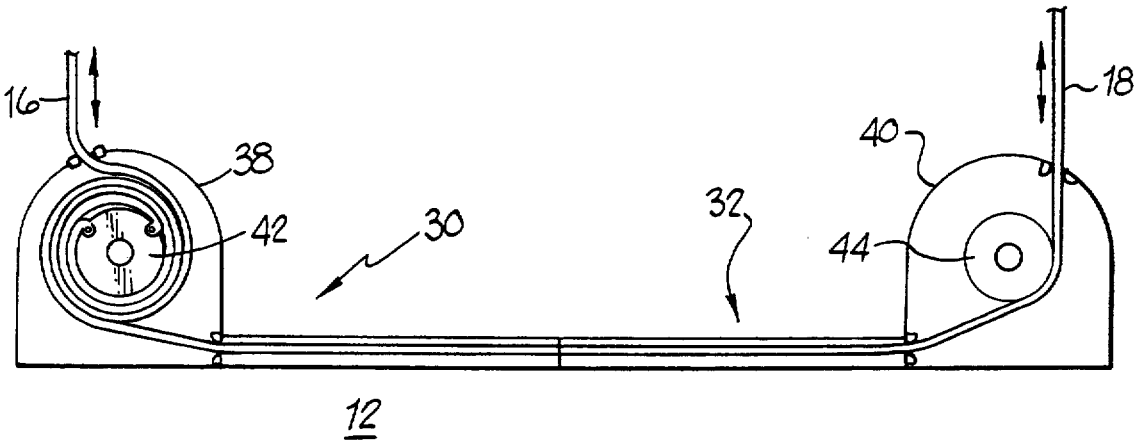
FIG. 5 is a pictorial cross-sectional diagram of the portable exercise device of FIGS. 1–3, illustrating the path of a strap within the base of FIG. 3.

Referring now additionally to FIGS. 3–5, base 12 comprises left and right members 30, 32 that are joined by corresponding left and right mating extrusions 34, 36 that are illustrated in cross section in FIG. 4. Thus, base 12 may be disassembled into left and right members 30, 32, for greater portability and may be assembled by engaging left and right extrusions 34, 36 in preparation for use. Left and right members 30, 32 of base 12 are formed to include corresponding left and right housings 38, 40 at the outer ends thereof. Each of the housings 38, 40 includes an opening through which straps 16, 18 enter and exit. Left housing 38 contains a supply/takeup reel 42 onto which left and right straps 16, 18 are wound in overlying arrangement when they are released by the user and retracted into base 12 and from which they are unwound when they are pulled by the user. Right housing 40 contains a simple idler pulley 44 over which strap 18 passes. Strap 18 is routed between left housing 38 and right housing 40 through a longitudinal slot 46 formed in the underside of extrusion 36. A sheath may be provided to enclose strap 18 as it passes underneath base 12 to prevent damage to a carpet in the event the portable exercise device is being used on that type of surface.

Figure 6:
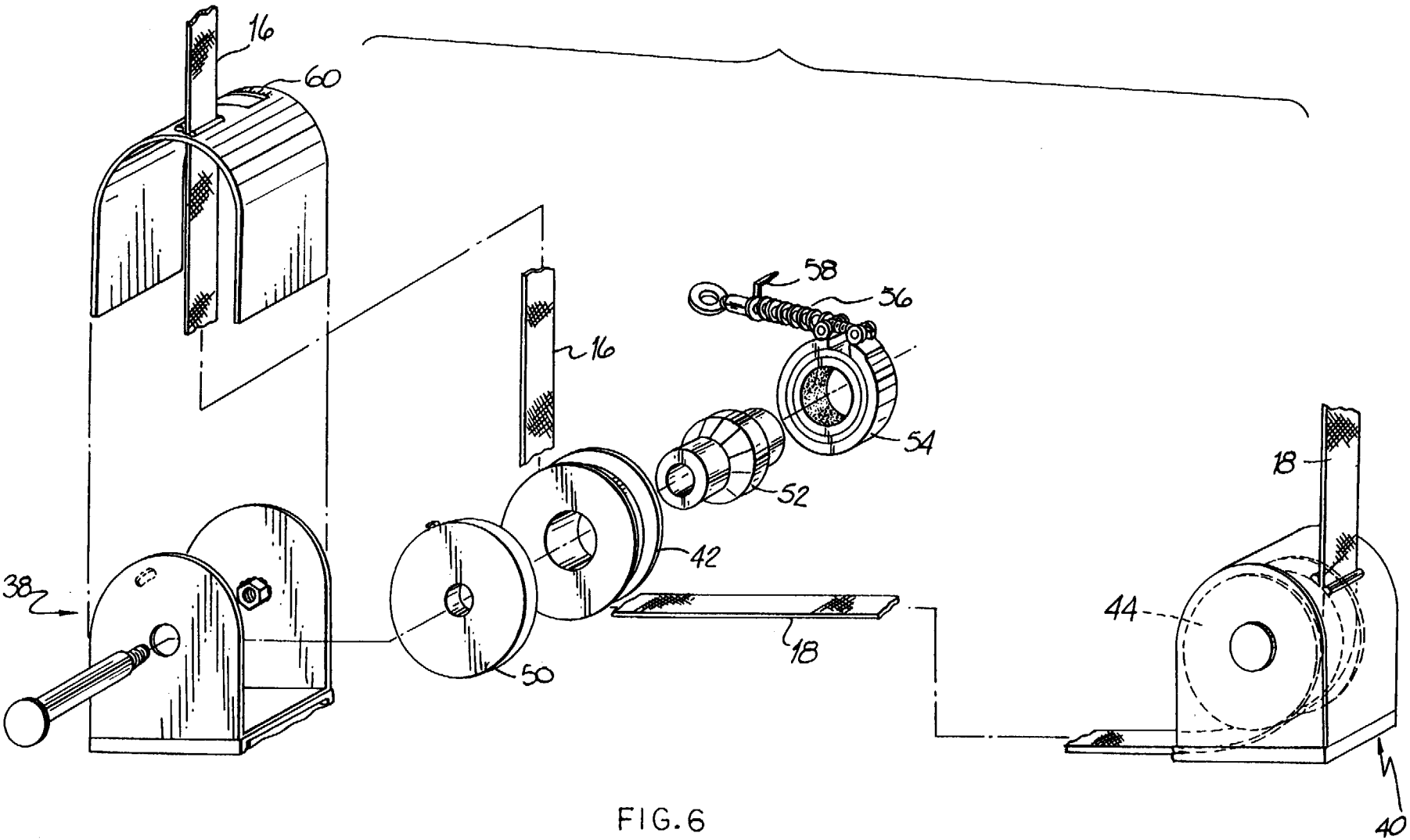
FIG. 6 is an exploded diagram of a portion of the base of FIG. 3.

Referring now to the exploded pictorial diagram of FIG. 6, left housing 38 contains a rewind spring 50 that is coupled to supply/takeup reel 42 to rewind straps 16, 18 onto the supply/takeup reel 42 when the user releases bar 14 of FIGS. 1 and 2. A one-way clutch 52 is coupled to supply/takeup reel 42, and a band brake 54 is coupled to one-way clutch 52. Band brake 54 may comprise any of a number of commercially available band brake assemblies, such as those manufactured by Comet Industries of Richmond, Va., for example. Rewind spring 50 and one-way clutch 52 are also readily available off-the-shelf components. One-way clutch 52 provides engagement with band brake 54 when straps 16, 18 are being pulled by the user from supply/takeup reel 42, and release from band brake 54 when straps 16, 18 are being rewound onto supply/takeup reel 42. A conventional screw mechanism 56 is employed to adjust the tension on band brake 54 and, thus, the frictional force applied by band brake 54 to one-way clutch 52 and, in turn, to supply/takeup reel 42. Screw mechanism 56 includes a pointer 58 that, in combination with calibration scale marking 60 on left housing 38, provides an indication of the force in pounds against which the user is working to pull straps 16, 18 from base 12.

We claim:

1. A portable exercise device on which a user may stand, sit or lie to perform a variety of exercises, the exercise device comprising:

left and right base members, said left base member having a rightwardly extending flat section and said right base member having a leftwardly extending flat section;

means for joining said rightwardly and leftwardly extending flat sections of said left and right base members to form a flat central section of said exercise device;

first and second strap housings, said first strap housing being positioned at a distal end of one of said left and right base members and said second strap housing being positioned at a distal end of the other one of said said left and right base members;

a single supply and takeup reel mounted for rotation within said first strap housing;

an idler pulley mounted for rotation within said second strap housing;

left and right straps, one of said left and right straps being fixedly attached at one end to said supply and takeup reel and having a free end that is routed underneath said left and right base members and around said idler pulley and that exits upwardly from said second strap housing, the other one of said left and right straps being fixedly attached at one end to said supply and takeup reel and having a free end that exits upwardly from said first strap housing;

a rewind spring coupled to said supply and takeup reel within said first strap housing for supplying a rewind force to rewind said left and right straps onto said supply and takeup reel;

a one-way clutch coupled to said supply and takeup reel and to said rewind spring within said first strap housing, said one-way clutch being engaged when said left and right straps are being unwound from said supply and takeup reel and being disengaged when said left and right straps are being rewound onto said supply and takeup reel;

a band brake coupled to said one-way clutch within said first strap housing for providing an adjustable resistance against which said left and right straps are unwound by a user from said supply and takeup reel; and an exercise bar to be gripped by the user, said exercise bar being adapted to be removably attached to the free ends of said left and right straps;

said means for joining said rightwardly and leftwardly extending flat sections of said left and right base members comprising left and right mating extrusions extending from said rightwardly and leftwardly extending flat sections of said left and right base members.

2. A portable exercise device as in claim 1 wherein said left and right mating extrusions form a longitudinal slot through which said one of said left and right straps is routed underneath said left and right base members.

3. A portable exercise device as in claim 1 wherein said left and right straps are fixedly attached to said supply and takeup reel in aligned relationship such that they overlie each other when being rewound onto said supply and takeup reel.

4. A portable exercise device as in claim 1 wherein said exercise bar includes means for adjusting the length thereof.

5. A portable exercise device as in claim 1 wherein:

said band brake includes resistance adjustment means for actuation by the user, said resistance adjustment means including a moving pointer whose position is indicative of a resistance setting of said band brake; and said first strap housing includes weight indicia positioned proximate said moving pointer, said weight indicia providing an indication to the user of a weight equivalent of a particular resistance setting.

* * * * *